US009162458B2

(12) United States Patent
Mimoto et al.

(10) Patent No.: US 9,162,458 B2
(45) Date of Patent: Oct. 20, 2015

(54) INKJET RECORDING APPARATUS

(71) Applicants: Masao Mimoto, Nagoya (JP); Yasuhira Ota, Yatomi (JP); Jie Xiu, Nagoya (JP); Noriyuki Kawamata, Nagoya (JP); Keisuke Wakakusa, Nagoya (JP); Iwane Sano, Obu (JP); Shingo Ito, Kasugai (JP)

(72) Inventors: Masao Mimoto, Nagoya (JP); Yasuhira Ota, Yatomi (JP); Jie Xiu, Nagoya (JP); Noriyuki Kawamata, Nagoya (JP); Keisuke Wakakusa, Nagoya (JP); Iwane Sano, Obu (JP); Shingo Ito, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/146,091

(22) Filed: Jan. 2, 2014

(65) Prior Publication Data

US 2014/0232789 A1 Aug. 21, 2014

(30) Foreign Application Priority Data

Feb. 18, 2013 (JP) ..... 2013-028565

(51) Int. Cl.

| | |
|---|---|
| ***B41J 3/00*** | (2006.01) |
| ***B41J 2/14*** | (2006.01) |
| ***B41J 11/00*** | (2006.01) |
| ***B41J 2/17*** | (2006.01) |
| ***B65H 29/52*** | (2006.01) |
| ***B65H 5/38*** | (2006.01) |

(52) U.S. Cl.

CPC ..... *B41J 2/1433* (2013.01); *B41J 2/1721* (2013.01); *B41J 11/0005* (2013.01); *B41J 11/005* (2013.01); *B65H 5/38* (2013.01); *B65H 29/52* (2013.01); *B41J 2002/1742* (2013.01); *B65H 2404/513* (2013.01); *B65H 2404/5214* (2013.01); *B65H 2404/61* (2013.01); *B65H 2801/06* (2013.01)

(58) Field of Classification Search

None

See application file for complete search history.

(56) References Cited

U.S. PATENT DOCUMENTS

| | | | | |
|---|---|---|---|---|
| 2008/0186374 | A1 | 8/2008 | Ito et al. | |
| 2012/0134733 | A1 * | 5/2012 | Ota et al. | 400/611 |

FOREIGN PATENT DOCUMENTS

| | | | |
|---|---|---|---|
| JP | 11-138923 | A | 5/1999 |
| JP | 2006-15533 | A | 1/2006 |
| JP | 2008-188783 | A | 8/2008 |
| JP | 2009-208245 | A | 9/2009 |

* cited by examiner

*Primary Examiner* — Erica Lin

(74) *Attorney, Agent, or Firm* — Merchant & Gould PC

(57) ABSTRACT

An inkjet recording apparatus includes a support member having a plurality of ribs and supporting the sheet; a head disposed above the support member and ejecting ink to the sheet supported by the support member; and at least one contact portion disposed upstream of the head and configured to come in contact with the sheet so as to make the sheet a waved shape. The support member includes a first support portion comprising at least one first guide portions disposed corresponding to the at least one contact portion, and a plurality of second guide portions disposed corresponding to the plurality of ribs and disposed above the plurality of first guide portions. The support member further comprises a second support portion comprising a third guide portion disposed downstream of the first support portion.

16 Claims, 10 Drawing Sheets

11
UP
7
DOWN
56
100
58
61
60
102
78
79
53
59
63
62
55
8
FRONT
REAR
90
57
80
88
42
85
83
75

INKJET RECORDING APPARATUS

CROSS REFERENCE TO RELATED APPLICATION

The present application claims priority from Japanese Patent Application No. 2013-028565, which was filed on Feb. 18, 2013, the disclosure of which is herein incorporated by reference to its entirety.

BACKGROUND OF THE INVENTION

1. Field of the Invention

The present invention relates to an inkjet recording apparatus which records an image on a sheet by ejecting ink droplets from nozzles.

2. Description of Related Art

In an inkjet recording apparatus comprising a recording portion configured to record an image on a sheet by ejecting ink droplets from nozzles disposed therein, a problem called "cockling" may occur. The cockling is a phenomenon in which permeation of ink into a sheet makes the sheet deformed, and it is known that due to the deformation of the sheet, the sheet is curved. When the cockling occurs in the sheet, a distance between the sheet and the recording portion changes during image recording. Accordingly, the deformed sheet comes into contact with the recording portion and the sheet is fed in a state in which a leading end of the sheet is displaced from a desired position, so that it is possible that a sheet jam occurs.

In order to solve the above-mentioned problem, there is known a recording apparatus, in which an elastic member is allowed to be in contact with a recording surface of the sheet at an upstream side of a landing area of ink droplets in a platen and is located between a plurality of ribs, which are formed in the platen, in a width direction that intersects with a feeding direction. The elastic member is elastically deformed so as to press the sheet toward a lower position than an upper end of each rib. Accordingly, the sheet becomes in a waved shape in the width direction, and, as a result, the sheet is hard to be curved.

SUMMARY OF THE INVENTION

However, in the above-described recording apparatus, there is no elastic member in the landing area of ink droplets and at a downstream side of the landing area in the feeding direction. Therefore, even if the sheet becomes in the waved shape at the upstream side of the landing area in the feeding direction, when the sheet passes the elastic member and is fed downstream in the feeding direction, there is possibility that the sheet cannot keep the waved shape. In a case where the sheet cannot keep the waved shape, it is possible that the sheet is curved. As a result, it is possible that the above-mentioned problems, i.e., the contact of the sheet with the recording portion and the sheet jam occur.

It is therefore an object of the present invention to provide an inkjet recording apparatus capable of maintaining the waved shape of the sheet formed at the upstream side of the landing area, while the waved shape is positioned at the downstream side of the landing area in the feeding direction.

In order to achieve the above-mentioned object, according to the present invention, there is provided an inkjet recording apparatus comprising: a support member having a plurality of ribs apart from each other in a width direction which intersects with a feeding direction which is a direction in which a sheet is fed, and configured to support a lower surface of the sheet at an upper end of each of the plurality of ribs; a head disposed above the support member and configured to eject ink to the sheet supported by the support member from nozzles; and at least one contact portion disposed upstream of the nozzles in the feeding direction and each disposed between corresponding two of the plurality of ribs adjacent to each other in the width direction, and configured to come in contact with an upper surface of the sheet in a state in which a lower surface of the sheet is supported by the plurality of ribs so as to make the sheet a waved shape, wherein the support member comprises: a first support portion comprising disposed downstream of a landing area of the support member and the plurality of ribs of the support member in the feeding direction, the landing area being an area on which ink droplets ejected from the nozzle land, wherein the first support portion comprises (a) at least one first guide portion disposed corresponding to the at least one contact portion in the width direction and located above the landing area, and (b) a plurality of second guide portions respectively disposed corresponding to the plurality of ribs in the width direction and located above the at least one first guide portion; and a second support portion comprising a third guide portion disposed downstream of the first support portion in the feeding direction, wherein one of opposite end portions of the third guide portion which is closer to the first support portion is located below the first guide portion.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Hereinafter, there will be described preferred embodiments of the invention with reference to the drawings. The present invention is not limited to the illustrated embodiments. It is to be understood that the present invention may be embodied with various changes and modifications that may occur to a person skilled in the art, without departing from the spirit and scope of the invention defined in the appended claims. Further, hereinafter, based on a state in which a MFD (Multi Function Device) 10 is installed in use (a state shown in FIG. 1), up-down directions 7 are defined, front-rear directions 8 are defined as a portion in which an opening 13 is disposed is a front portion of the MFD 10, and left-right directions 9 are defined as the MFD 10 is seen from the front portion.

[MFD 10]

Figure 1:
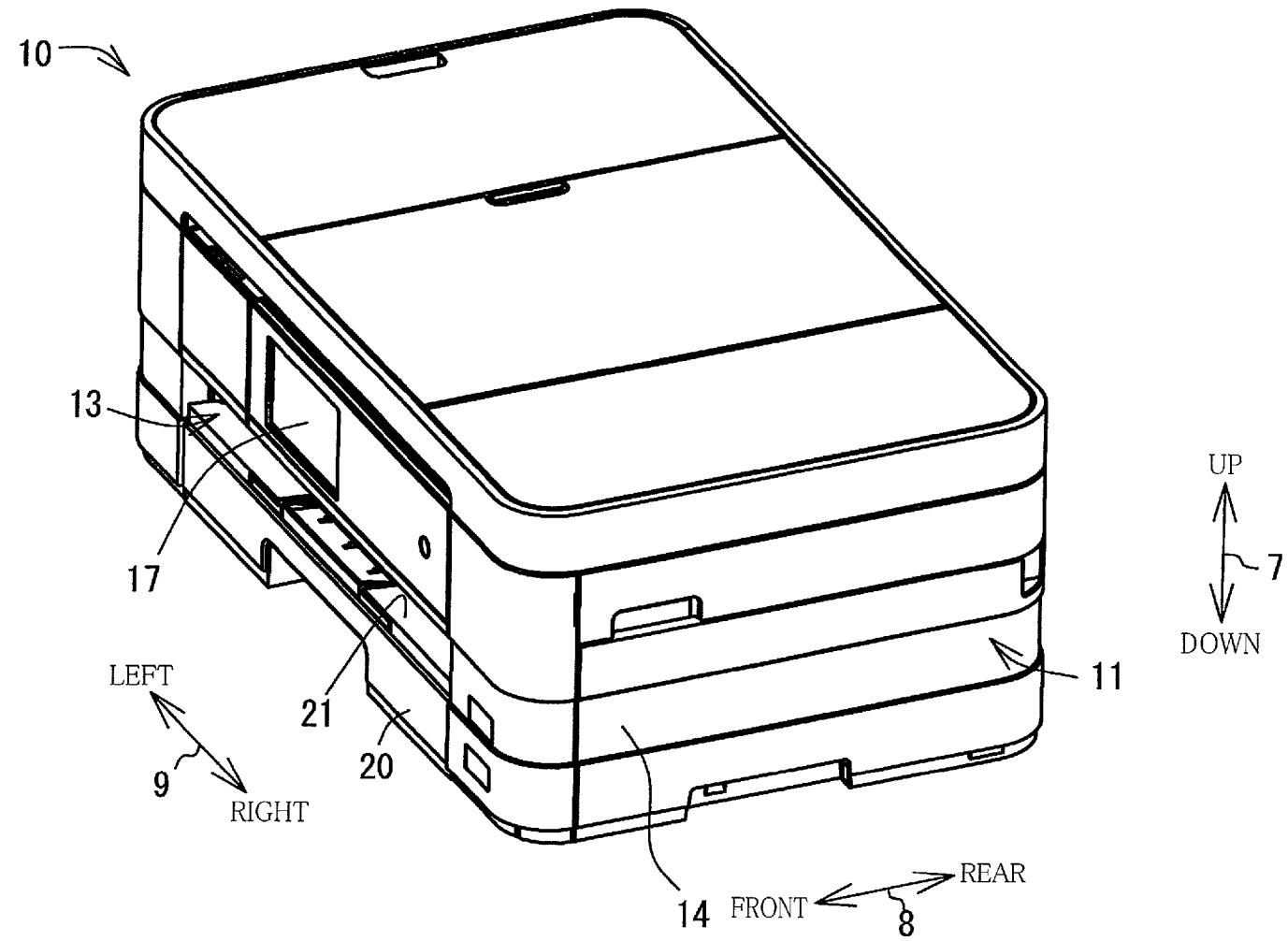
FIG. 1 is a perspective view showing a Multi Function Device (MFD) as one embodiment to which the present invention is applied.

As shown in FIG. 1, the MFD 10 as an example of an inkjet recording apparatus has a generally flat rectangular parallelepiped shape and has a printer portion 11 in a lower portion thereof. The MFD 10 has various functions such as a facsimile-machine function and a printer function. The MFD 10 has, as the printer function, a function of recording an image on a single side of a recording sheet 12 (shown in FIG. 2). The MFD 10 may record an image on both sides of the recording sheet 12. The printer portion 11 has a housing 14 having the opening 13 on the front portion thereof. A sheet-supply tray 20 and a sheet-discharge tray 21 can be attached to and detached from the opening 13 in the front-rear directions 8. In the sheet-supply tray 20, the recording sheets 12 of a desired size are placed.

Figure 2:
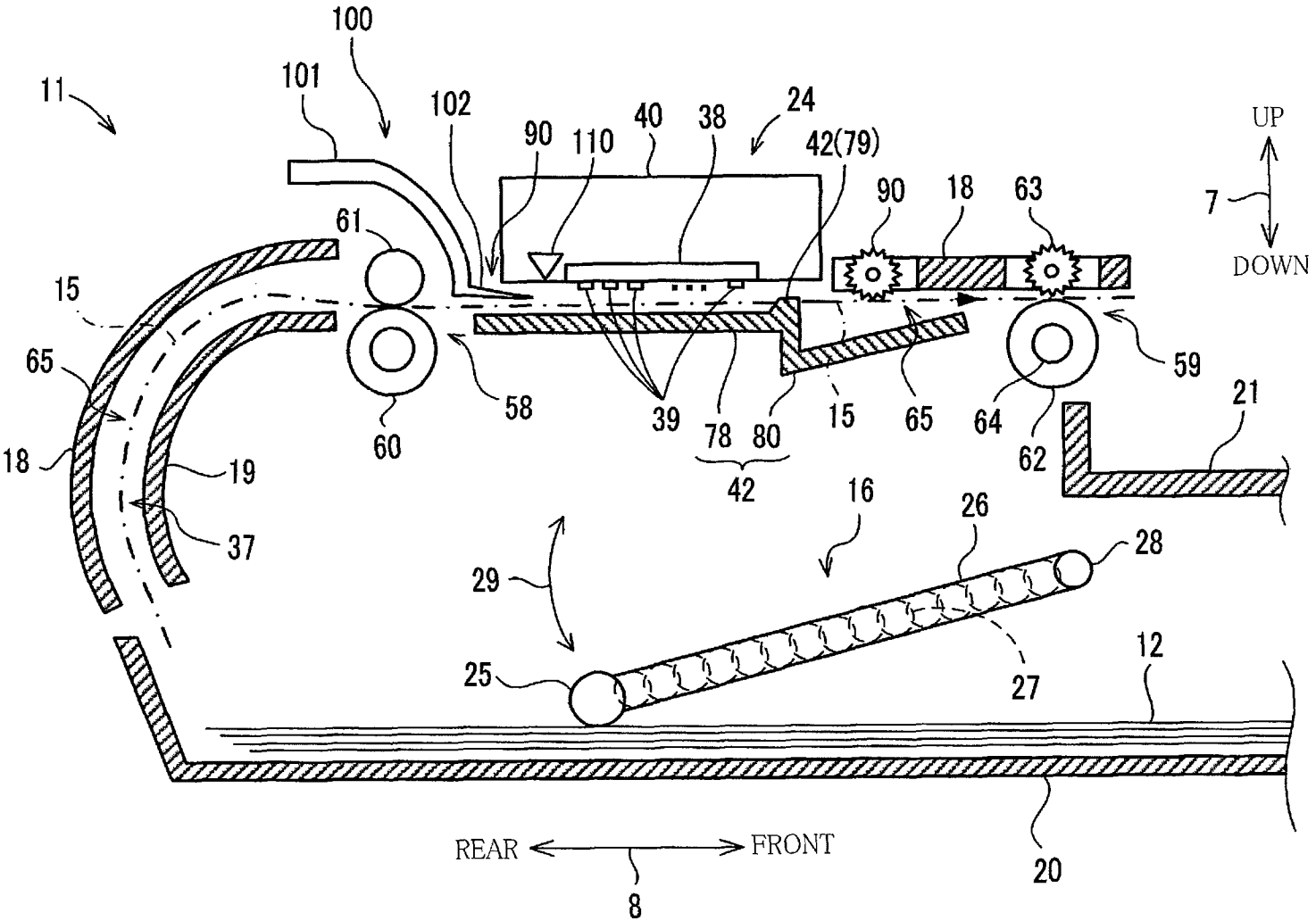
FIG. 2 is a cross-sectional view schematically showing an internal structure of a printer portion.

As shown in FIG. 2, the printer portion 11 has a sheet-supply portion 16 which supplies the recording sheet 12 to a feeding path 65, a pair of feeding rollers 58 and a pair of discharge rollers 59 (an example of a pair of rollers) each of which feeds the recording sheet 12 supplied to the feeding path 65, a platen 42 (an example of a support member) which supports the recording sheet 12 fed through the feeding path 65, a recording portion 24 which records an image on the recording sheet 12 supported by the platen 42, and so on.

[Sheet-Supply Portion 16]

As shown in FIG. 2, the sheet-supply portion 16 is disposed above the sheet-supply tray 20. The sheet-supply portion 16 includes a sheet-supply roller 25, a sheet-supply arm 26 and a drive transmission mechanism 27 having a plurality of gears that are meshed with each other. The sheet-supply roller 25 is pivotally supported on one end portion of the sheet-supply arm 26. The sheet-supply arm 26 is rotationally movable in a direction indicated by an arrow 29 about a shaft 28 that is disposed in the other end portion of the sheet-supply arm 26. Therefore, the sheet-supply roller 25 is allowed to be in contact with and be apart from the sheet-supply tray 20. The drive transmission mechanism 27 transmits a drive force of a sheet-supply motor such that the sheet-supply roller 25 is rotated. The sheet-supply roller 25, being in contact with an uppermost one of the recording sheets 12 stacked on the sheet-supply tray 20, separates the uppermost recording sheet 12 from the other recording sheets 12 and supplies the recording sheet 12 to the feeding path 65.

[Feeding Path 65]

As shown in FIG. 2, the recording portion 24 is disposed above a straight portion of the feeding path 65. The feeding path 65 includes a curved portion and the straight portion. The curved portion of the feeding path 65 extends in such a curved way that a rear side of the curved portion is located outside of the curved portion and a front side thereof is located inside thereof. The straight portion extends in the front-rear directions 8. The feeding path 65 is formed by an outer guide member 18 and an inner guide member 19 that are opposed to each other at a predetermined distance. The recording sheet 12 supplied from the sheet-supply tray 20 to the feeding path 65 by the sheet-supply portion 16 is fed in a U-turn manner from a lower portion to an upper portion through the curved portion of the feeding path 65, and then, fed through the straight portion of the feeding path 65 to the recording portion 24. The recording sheet 12 on which an image has been recorded by the recording portion 24 is fed through the straight portion of the feeding path 65 to be discharged onto the sheet-discharge tray 21. In other words, the recording sheet 12 is fed in a feeding direction 15 indicated by a one-dot chain line arrow in FIG. 2.

[Recording Portion 24]

As shown in FIG. 2, the recording portion 24 is disposed above the straight portion of the feeding path 65. The recording portion 24 includes a carriage 40 and a recording head 38. The carriage 40 carries the recording head 38 and is reciprocatable in a main scanning direction, i.e., in the left-right directions 9 as a direction perpendicular to a sheet plane of FIG. 2. The carriage 40 is supported by a guide rail 56 (shown in FIGS. 3 through 5) that is attached to a pair of frames 55 (shown in FIGS. 5 and 6) disposed in the printer portion 11, and a guide rail 53 (shown in FIGS. 3 and 4) that is disposed downstream of the guide rail 56 in the feeding direction 15 at a predetermined distance from the guide rail 56. The carriage 40 is disposed over the two guide rails 56, 53 so as to be slidable in the main scanning direction (in the left-right directions 9) on the guide rails 56, 53.

The recording head 38 is carried by the carriage 40. Ink is supplied from ink cartridges to the recording head 38. There are formed nozzles 39 on a lower surface of the recording head 38. The recording head 38 ejects ink as tiny ink droplets through the nozzles 39. The nozzles 39 eject ink droplets toward the platen 42 that is disposed below the straight portion of the feeding path 65 so as to be opposed to the recording portion at a predetermined interval. The recording sheet 12 fed in the feeding direction 15 is supported by an upper surface of the platen 42.

Accordingly, while the carriage 40 is reciprocated in the main scanning direction, ink droplets are ejected from the nozzles 39 formed in the recording head 38 toward the recording sheet 12 guided on the platen 42 along the straight portion of the feeding path 65. An image is thus recorded on the recording sheet 12. The platen 42 will be described in more detail.

[Pair of Feeding Rollers and Pair of Discharge Rollers]

Figure 3:
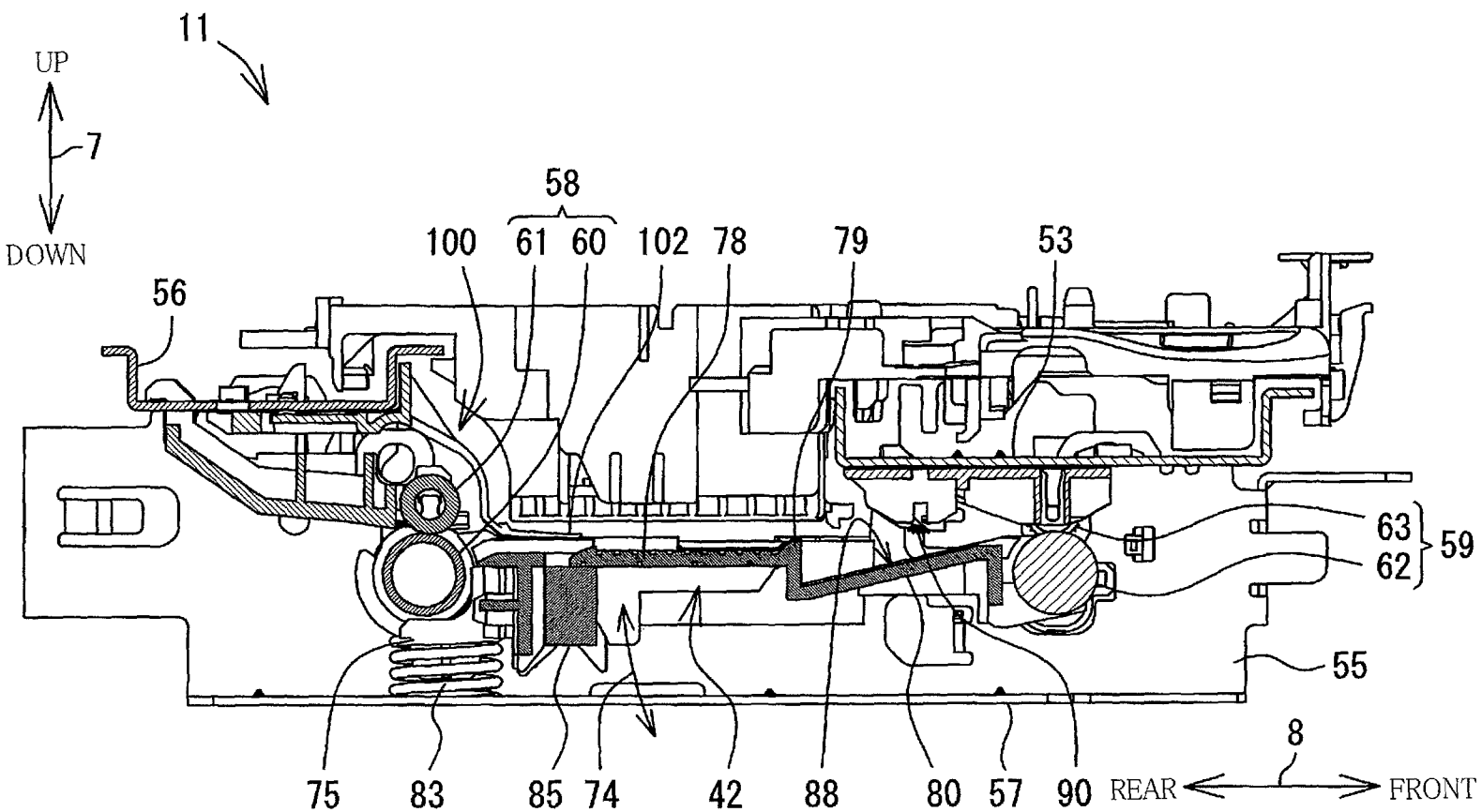
FIG. 3 is a cross-sectional view of a platen and its vicinity that are disposed in the printer portion in a state in which the platen is not pressed by a recording sheet.
Figure 4:
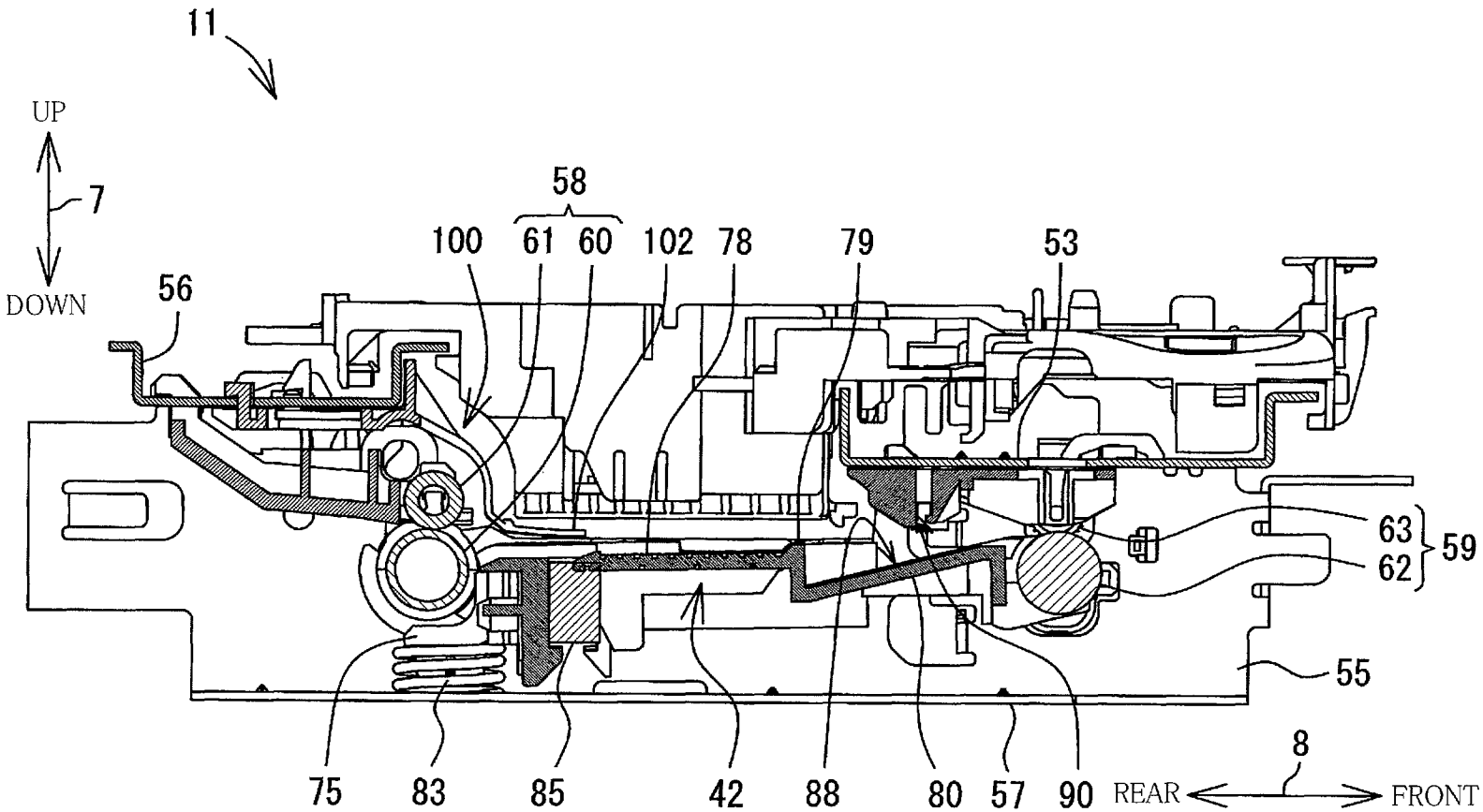
FIG. 4 is a cross-sectional view of the platen and its vicinity in a state in which the platen is pressed by the recording sheet so as to be rotationally moved downward.

As shown in FIGS. 2 through 4, in an upstream side of the platen 42 in the feeding direction 15 in the straight portion of the feeding path 65, there are disposed a pair of feeding rollers 58 constituted by a feeding roller 60 located below the straight portion of the feeding path 65 and a pinch roller 61 located above the straight portion thereof to be opposed to the feeding roller 60. The pinch roller 61 is held in pressure contact with a roller surface of the feeding roller 60 by an elastic member such as a spring.

In a downstream side of the platen 42 (more specifically, a second support portion 80 described later) in the feeding direction 15 in the straight portion of the feeding path 65, there are disposed a pair of discharge rollers 59 constituted by a discharge roller 62 located below the straight portion of the feeding path 65 and a spur 63 located above the straight portion thereof to be opposed to the discharge roller 62. The spur 63 is held in pressure contact with a roller surface of the discharge roller 62 by an elastic member such as a spring.

The feed roller 60 and the discharge roller 62 are rotated by transmission of a rotation drive force from the feeding motor through the drive transmission mechanism. When the feeding roller 60 is rotated in a state in which the recording sheet 12 is nipped by the pair of feeding rollers 58, the recording sheet 12 is fed onto the platen 42, i.e., in the feeding direction 15. When the discharge roller 62 is rotated in a state in which the recording sheet 12 is nipped by the pair of discharge rollers 59, the recording sheet 12 is fed in the feeding direction 15 by the pair of discharge rollers 59. Accordingly, each of the pair of feeding rollers 58 and the pair of discharge rollers 59 nip and feed the recording sheet 12 in the feeding direction 15.

Figure 5:
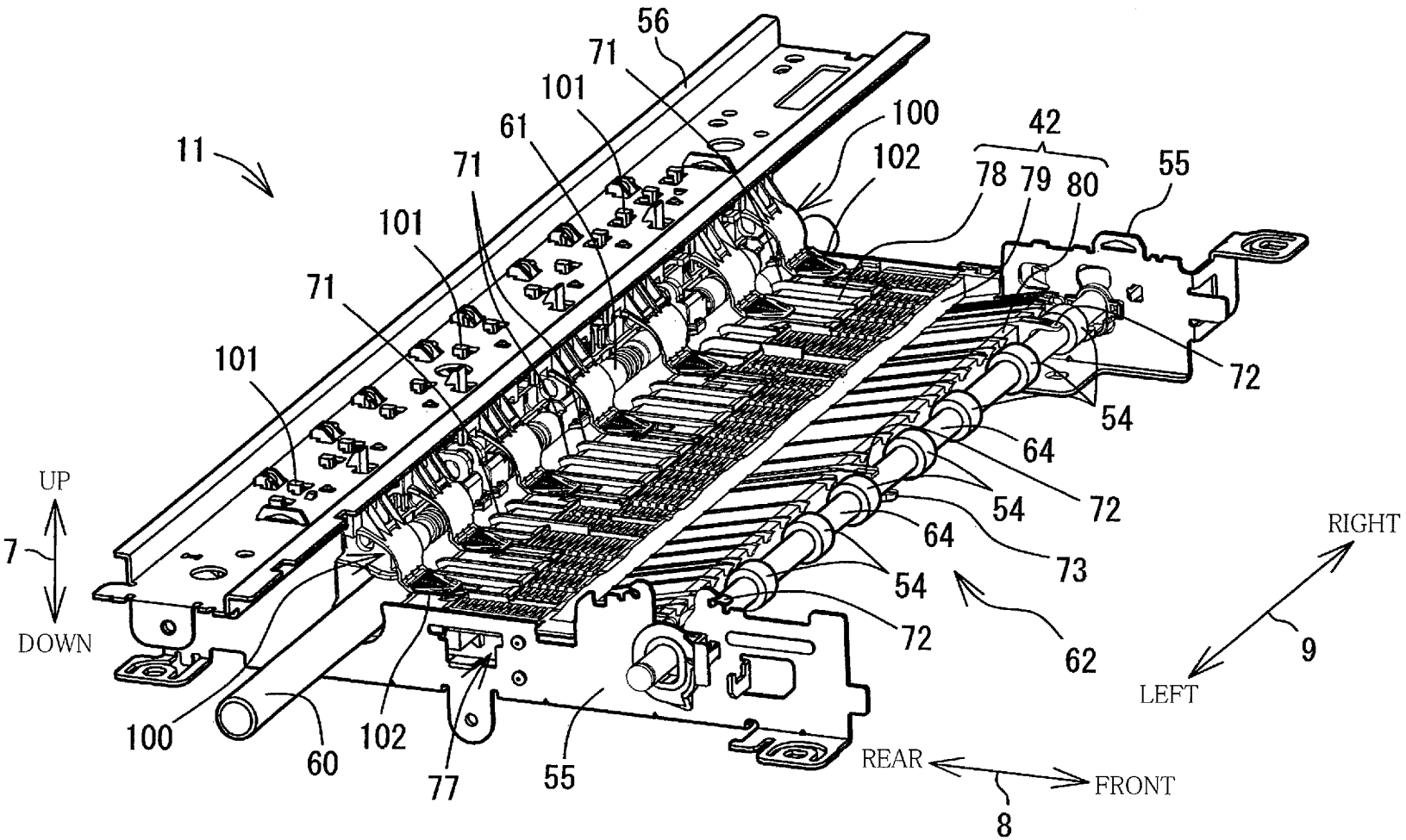
FIG. 5 is a perspective view of the platen and its vicinity.
Figure 6:
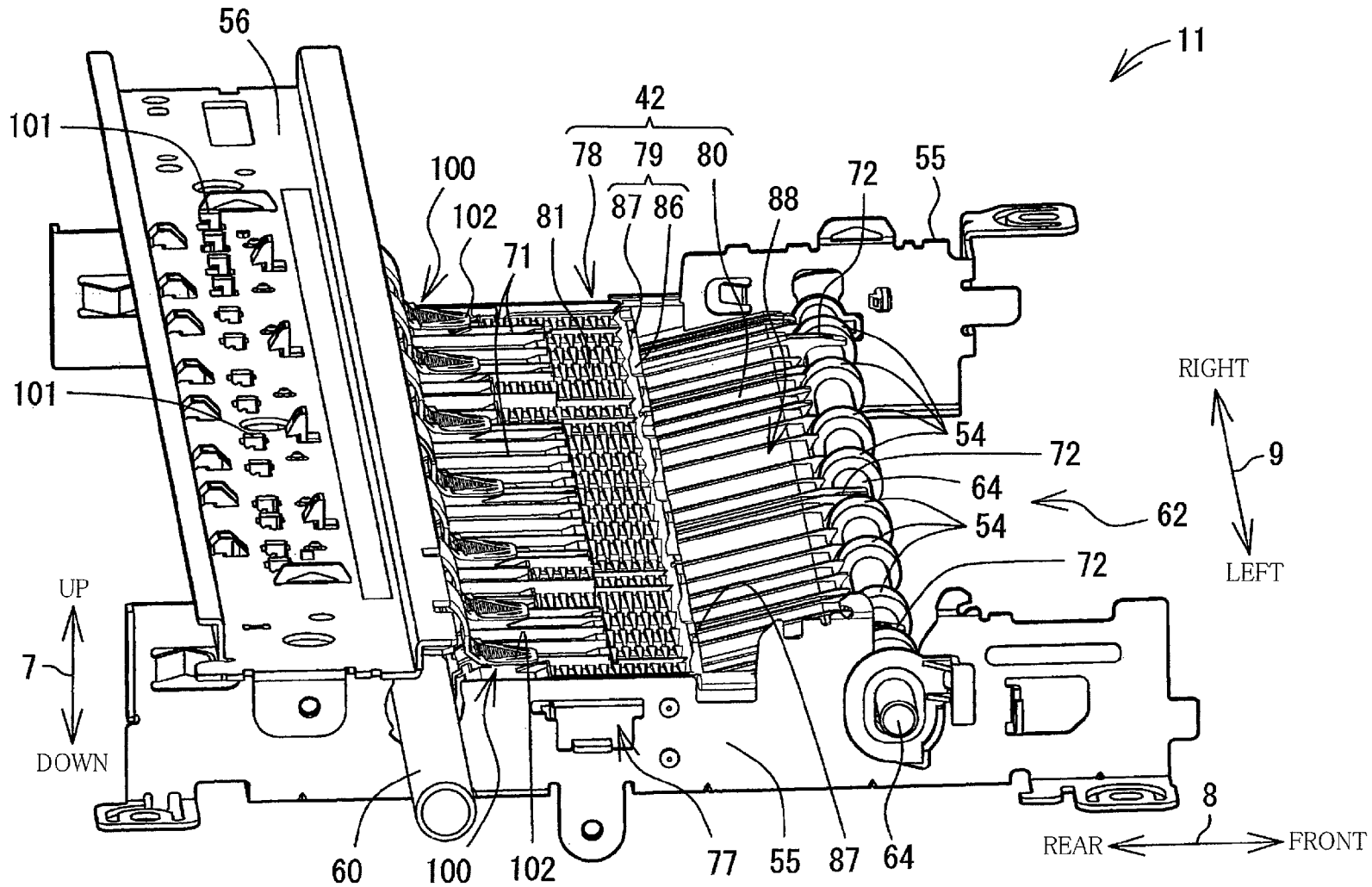
FIG. 6 is another perspective view of the platen and its vicinity.

As shown in FIGS. 5 and 6, the discharge roller 62 is constituted by a shaft 64 and a roller portion 54 whose diameter is greater than that of the shaft 64. A plurality of roller portions 54 are disposed to be apart from each other in the left-right directions 9. The shaft 64 is inserted into each roller portion 54. When the recording sheet 12 is nipped and fed by the pair of discharge rollers 59, a circumferential surface of each roller portion 54 is in contact with the recording sheet 12.

The feeding roller 60 of the pair of feeding rollers 58 and the discharge roller 62 of the pair of discharge rollers 59 each located below the feeding path 65 are rotatably supported by the pair of frames 55, and the pinch roller 61 of the pair of feeding rollers 58 and the spur 63 of the pair of discharge rollers 59 each located above the feeding path 65 are rotatably supported by a pair of frames different from the pair of frames 55.

[Contact Member 100]

As shown in FIGS. 2 through 4, there are disposed a plurality of contact members 100 (an example of at least one contact portion) at an upstream side of the nozzles 39 formed in the recording head 38 of the recording portion 24 in the feeding direction 15. As shown in FIGS. 5 and 6, the plurality (seven in the present embodiment) of contact members 100 are arranged to be apart from each other in the left-right directions 9. One end portion 101 (a base end portion) of each contact member 100 is attached to the guide rail 56. Each contact member 100 extends downward and frontward in a curved manner from the one end portion 101. The other end portion 102 of each contact member 100 extends frontward (in more detail, frontward and slightly obliquely downward) from an end of the curved portion of the contact member 100. A lower surface of the other end portion 102 of each contact member 100 is contactable with an upper surface of the recording sheet 12.

In the present embodiment, the plurality of contact members 100 are disposed in the MFD 10, but one contact member 100 may be disposed in the MFD 10. For example, the contact member 100 may have a plurality of end portions 102 and one end portion 101 in such a way that a plurality of end portions 101 are connected to each other, and as a result, the contact member 100 may be structured as one individual member.

The plurality of contact members 100 are respectively located at positions in the left-right directions 9 different from a plurality of ribs 71 described later (shown in FIGS. 5 through 8) that are formed in the platen 42. In other words, each of the plurality of contact members 100 is located at a position between corresponding two of the plurality of ribs 71 adjacent to each other in the left-right directions 9.

[Platen 42]

Figure 7:
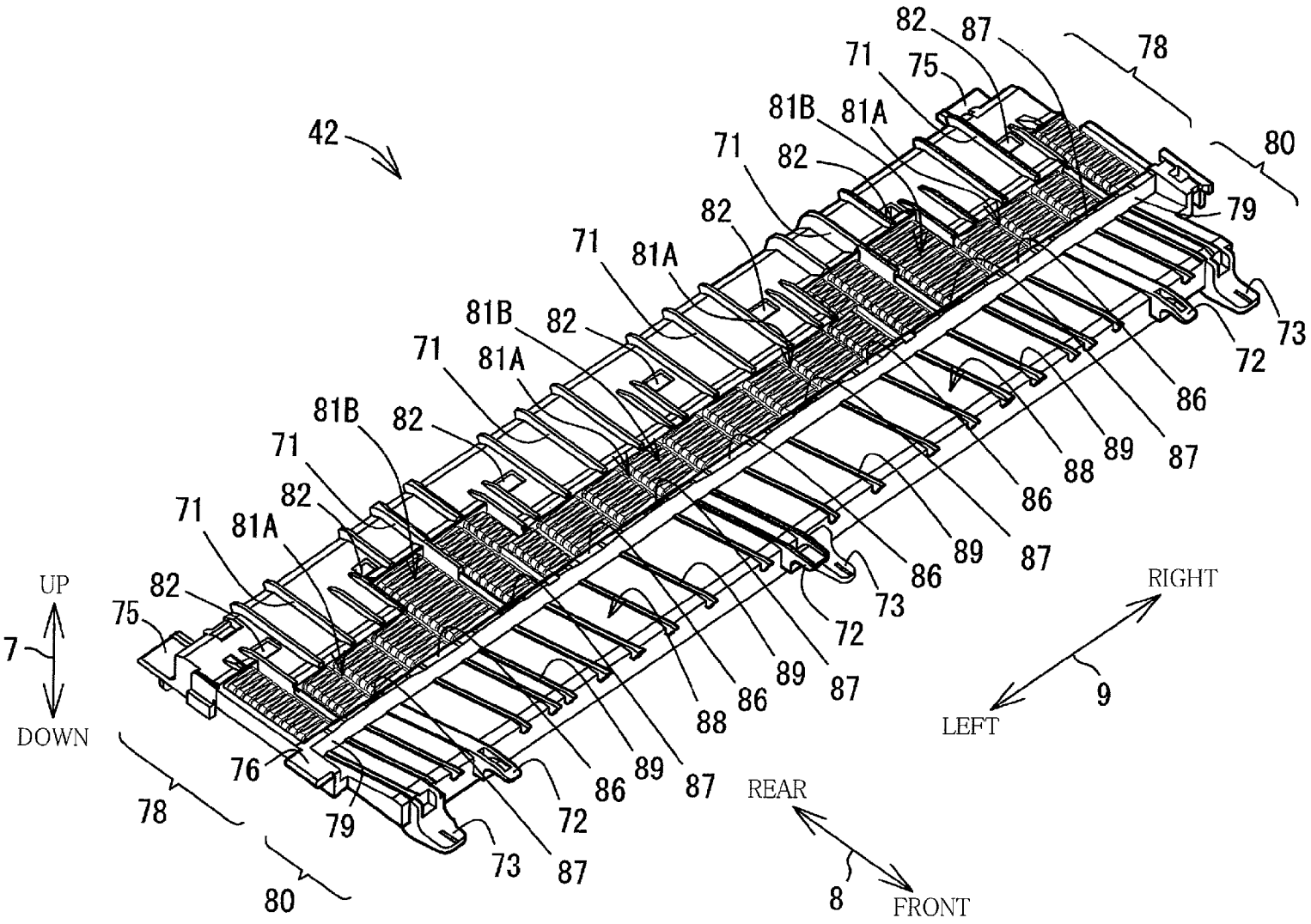
FIG. 7 is a perspective view of the platen as seen from an obliquely upper portion thereof.
Figure 8:
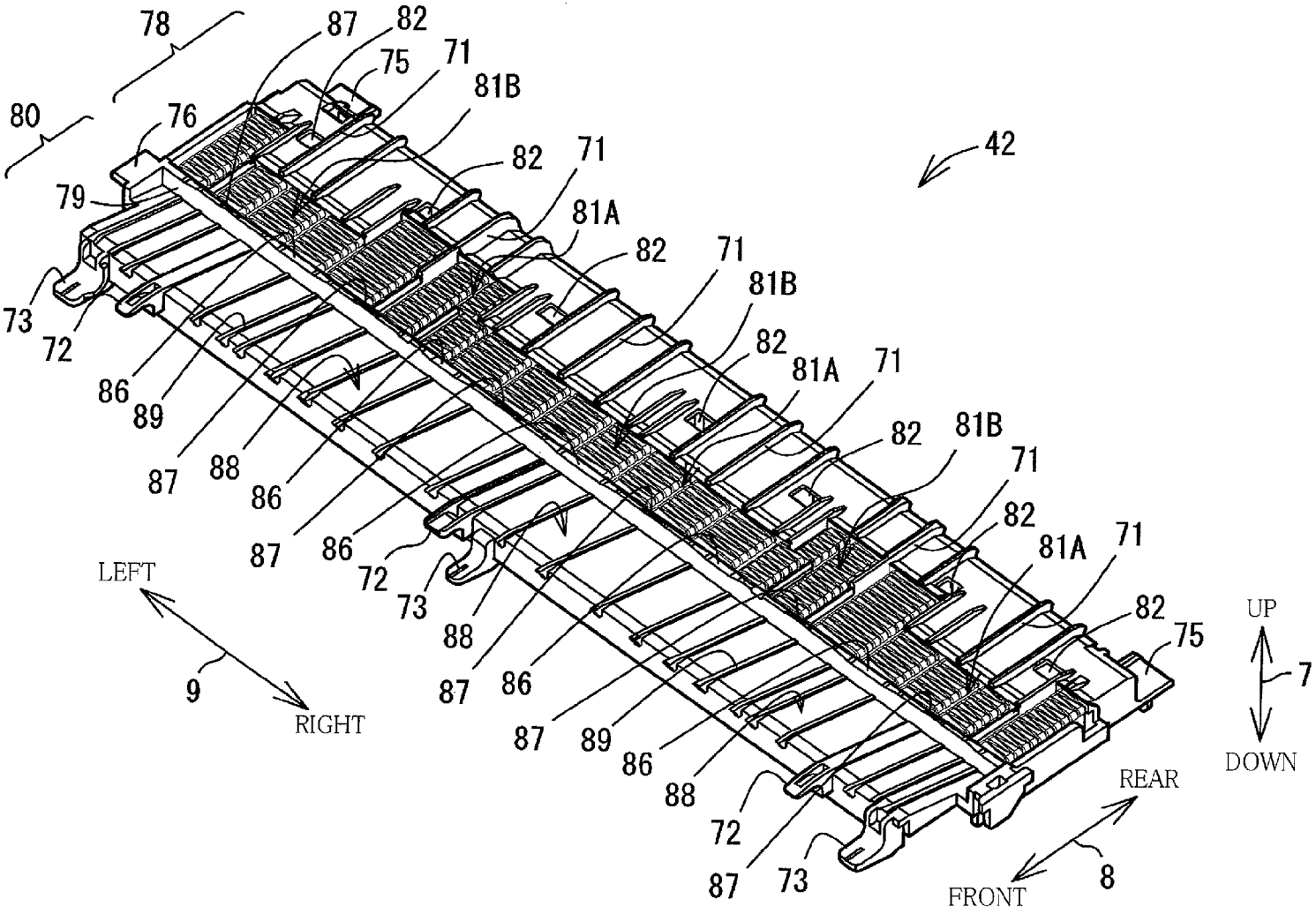
FIG. 8 is another perspective view of the platen as seen from the obliquely upper portion thereof.

As shown in FIG. 2, the platen 42 is disposed below the recording portion 24 to be opposed to the recording portion 24. As shown in FIGS. 7 and 8, the platen 42 is a flat-plate member which extends longer in the front-rear directions 8 and in the left-right directions 9 than in the up-down directions 7. The plurality of ribs 71 described later are formed on the upper surface of the platen 42, and each rib 71 is contactable with a lower surface of the recording sheet 12 fed in the feeding path 65. In other words, the platen 42 supports the recording sheet 12 from a lower portion thereof at upper ends of the respective ribs 71.

The platen 42 is supported by the shaft 64 of the discharge roller 62 of the pair of discharge rollers 59 that is located below the feeding path 65 so as to be rotationally movable. Specifically, in the platen 42, there are formed a plurality of first front projecting portions 72 each of which projects frontward from an upper portion of a front end surface of the platen 42, and a plurality of second front projecting portions 73 each of which projects frontward from a lower portion of the front end surface of the platen 42. As shown in FIG. 5, the platen 42 is disposed in the MFD 10 in a state in which the first front projecting portions 72 are in contact with upper portions of the shaft 64 and the second front projecting portions 73 are in contact with lower portions of the shaft 64, i.e., in a state in which the shaft 64 is nipped by the first front projecting portions 72 and the second front projecting portions 73. Accordingly, the platen 42 is rotationally movable about the shaft 64 in a direction of an arrow 74 (shown in FIG. 3).

Figure 9:
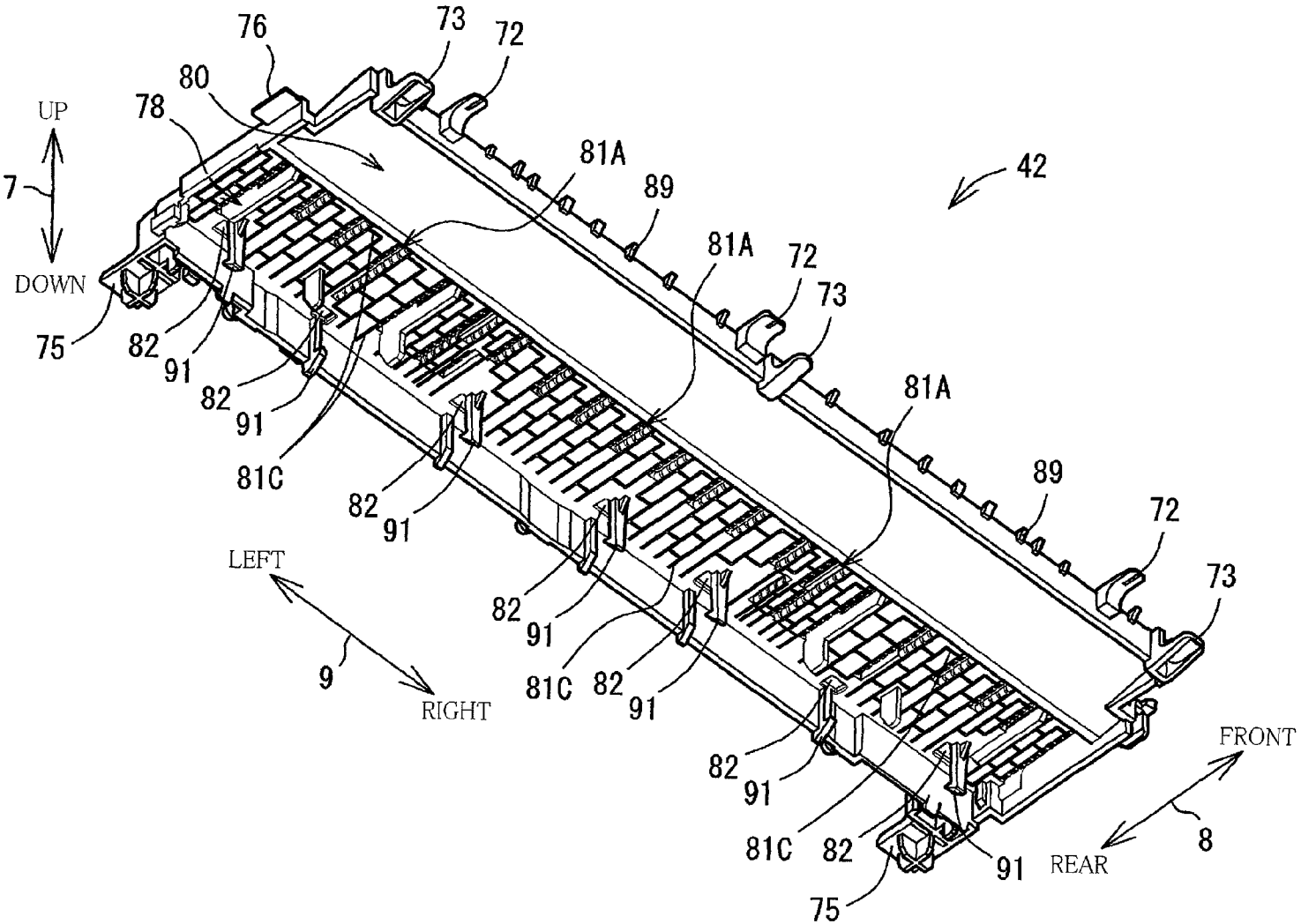
FIG. 9 is a perspective view of the platen as seen from an obliquely lower portion thereof.

As shown in FIGS. 7 through 9, in the platen 42, there are formed a plurality of rear projecting portions 75 each of which projects rearward from a rear surface of the platen 42. As shown in FIGS. 3 and 4, to a lower surface of each rear projecting portion 75, one end of a coil spring 83 (an example of a force applying member) is attached. The other end of the coil spring 83 is attached to the frame 57 of the printer portion 11.

Further, as shown in FIGS. 7 through 9, in the platen 42, there is formed a side projecting portion 76 which projects outward from a (left) side surface of the platen 42. On the other hand, as shown in FIGS. 5 and 6, in (a left) one of the pair of frames 55, there is formed an opening 77. The side projecting portion 76 is inserted into the opening 77. The platen 42 is disposed in the printer portion 11 in a state in which the side projecting portion 76 is in contact with an upper edge of the opening 77. In the above-described state, the coil spring 83 is compressed from its natural length. In other words, the platen 42 is pressed upward by the coil spring 83, and an upward movement of the platen 42 by the force of the coil spring 83 is restrained by the contact of the side projecting portion 76 with the upper edge of the opening 77.

As shown in FIG. 3, in a state in which the platen 42 is not in contact with the recording sheet 12, the side projecting portion 76 is in contact with the upper edge of the opening 77 by the force of the coil spring 83 such that the platen 42 is positioned at a first position where an upper surface (in more detail, an upper surface of a main support portion 78 described later) of the platen 42 is maintained in a horizontal state. In other words, the coil spring 83 applies the force such that the platen 42 is positioned at the first position. On the other hand, as shown in FIG. 4, the platen 42 is pressed by the recording sheet 12 fed in the feeding path 65 so as to be rotationally moved downward. Therefore, in a state in which the platen 42 is positioned at a second position, a movement end of the platen 42, i.e., an upstream end of the platen 42 in the feeding direction 15 is positioned at a lower position than the upstream end of the platen 42 in the feeding direction 15 in a state in which the platen 42 is positioned at the first position. In other words, the platen 42 is rotationally movable about the shaft 64 between the first position and the second position where a distance between the recording portion 24 and the platen 42 is greater than that in the state in which the platen 42 is positioned at the first position.

Furthermore, the platen 42 includes the main support portion 78 having a landing area (described later) on which ink droplets ejected from the nozzles 39 are landed, a first support portion 79 located at a downstream side of the main support portion 78 in the feeding direction 15, and a second support portion 80 located at a downstream side of the first support portion 79 in the feeding direction 15. In other words, the platen 42 has the first support portion 79 between the main support portion 78 and the second support portion 80 in the front-rear directions 8. Further, in the platen 42, in addition to the first front projecting portions 72 and the second front projecting portions 73, there are formed an ink channel 81 and a plurality of openings 82.

[Main Support Portion 78]

As shown in FIGS. 5 through 8, the main support portion 78 is constituted by a rear portion of the platen 42 having the flat plate structure. A position where the main support portion 78 is disposed in the platen 42 corresponds to a position including an area opposed to an area where the nozzles 39 are disposed in the recording head 38. Ink droplets ejected from the nozzles 39 can land on the area of an upper surface of the main support portion 78 that is opposed to the area where the nozzles 39 are disposed in the recording head 38. The above-mentioned area of the upper surface of the main support portion 78 on which ink droplets land is an example of a landing area. In other words, the landing area is an area constituted by at least a part of the upper surface of the main support portion 78, and an area extending from the nozzle 39 located at the most forward position to the nozzle 39 located at the most rearward position in the front-rear directions 8, and an area extending, in the left-right directions 9, from the rightmost nozzle 39 in a state in which the carriage 40 is moved to the rightmost position during an image recording operation to the leftmost nozzle 39 in a state in which the carriage 40 is moved to the leftmost position during the image recording operation.

Furthermore, as shown in FIGS. 7 through 9, the plurality of ink channels 81 are formed on the upper surface and a lower surface of the main support portion 78. The plurality of ink channels 81 are formed on a front portion of the upper surface of the main support portion 78 and on a generally whole area of the lower surface of the main support portion 78. The ink channels 81 will be described in detail later.

[Rib 71]

As shown in FIGS. 5 through 8, the plurality of ribs 71 are formed on the upper surface of the main support portion 78. Each rib 71 stands upward from the upper surface of the main support portion 78. Further, the ribs 71 are spaced or distanced from each other in the left-right directions 9 (an example of a width direction) that intersect with the feeding direction 15. Each rib 71 extends in the front-rear directions 8.

In the present embodiment, each rib 71 is formed only in a rear portion of the main support portion 78 in the front-rear directions 8, not in a front portion thereof. More specifically, a range where the plurality of ribs 71 are formed in the front-rear directions 8 on the upper surface of the main support portion 78 includes a range where the ink channels 81 are not formed in the front-rear directions 8, and the range where the plurality of ribs 71 are formed on the upper surface of the main support portion 79 overlaps a range where the ink channels 81 are formed in the front-rear directions 8 on the upper surface of the main support portion 78. However, the range where the plurality of ribs 71 are formed in the front-rear directions 8 is not limited to the above-mentioned range. For example, the plurality of ribs 71 may be formed over a whole area of the upper surface of the main support portion 78 in the front-rear directions 8. It is preferable that at least a part of the range where the plurality of ribs 71 are formed is identical in the front-rear directions 8 to a range where the plurality of contact members 100, mentioned before, are formed in the front-rear directions 8.

Figure 10:
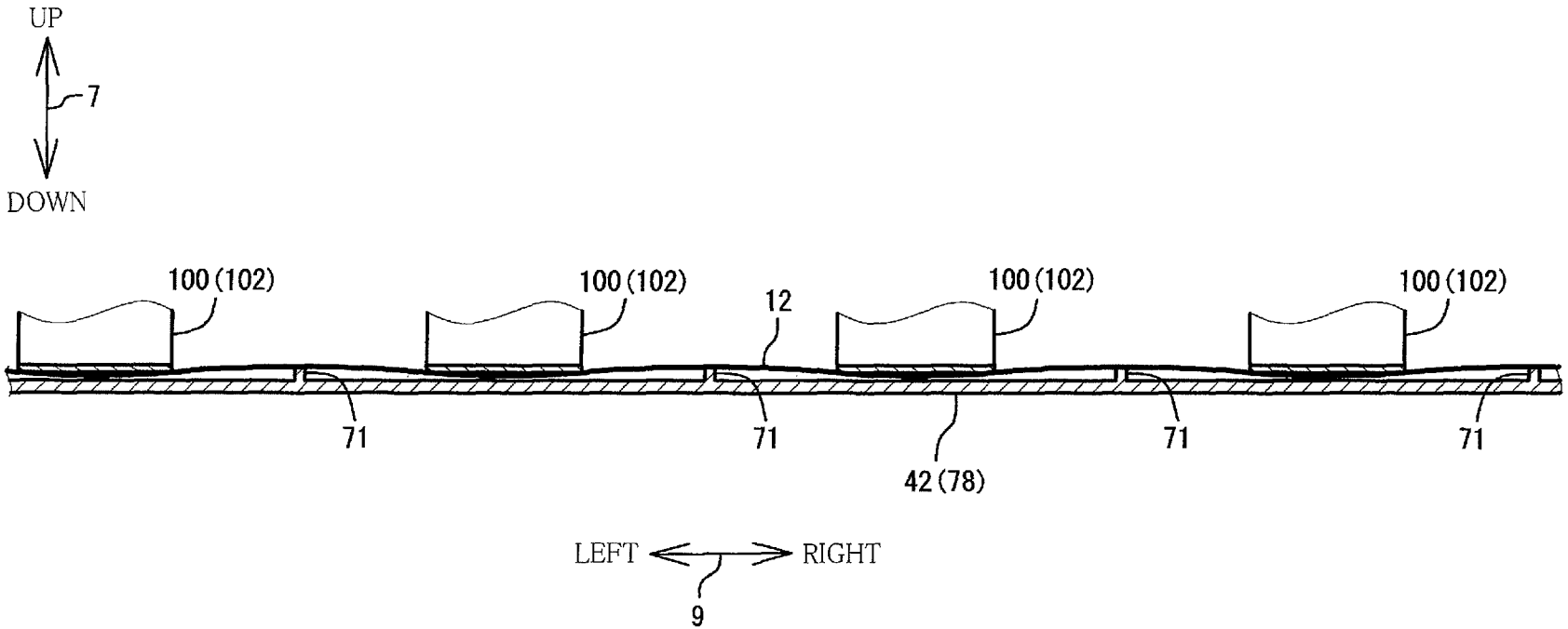
FIG. 10 is a cross-sectional view showing the platen, a contact member, and the recording sheet.

An upper end of each rib 71 is located above a lower end of the contact member 100 (in detail, a lower end of the end portion 102 of the contact member 100). Accordingly, as shown in FIG. 10, the contact members 100 and the ribs 71 make the recording sheet 12 that is fed below the contact members 100 in the feeding path 65 a waved shape extending continuously in the left-right directions 9. In other words, the contact members 100 cooperate the ribs 71 to make the recording sheet 12 the waved shape by the contact with an upper surface of the recording sheet 12.

In the present embodiment, the upper end of each rib 71 is located above the lower end of the contact member 100, but the upper end of each rib 71 may be located at the same position as the lower end of the contact member 100 in the up-down directions 7, or the upper end of each rib 71 may be located below the lower end of the contact member 100, on condition that the ribs 71 and the contact members 100 can make the recording sheet 12 the waved shape. For example, even if the upper end of each rib 71 is located below the lower end of the contact member 100, in a case where a distance between the upper end of each rib 71 and the lower end of the contact member 100 in the up-down directions 7 is smaller than a thickness of the recording sheet 12, the contact members 100 and the ribs 71 can make the recording sheet 12 the waved shape.

[First Support Portion 79]

As shown in FIGS. 3 and 4, the first support portion 79 is formed at a front portion of the main support portion 78 of the platen 42 in the front-rear directions 8, i.e., at a downstream side of the landing area and the ribs 71 formed on the main support portion 78 in the feeding direction 15.

As shown in FIGS. 7 and 8, the first support portion 79 extends longer in the left-right directions 9 than in the front-rear directions 8 and extends from a right end of the platen 42 to a left end thereof in the left-right directions 9. Further, as shown in FIGS. 3 and 4, the first support portion 79 stands upward from the upper surface of the platen 42. In other words, an upper surface of the first support portion 79 is located above the upper surface of the platen 42.

As shown in FIGS. 6 through 8, the upper surface of the first support portion 79 has a concave-convex shape in which a plurality of protruding portion and a plurality of recessed portion are continuously formed in the left-right directions 9. Each of a plurality of first surfaces 86 (an example of a plurality of first guide portions) corresponding to an upper surface of the recessed portion of the first support portion 79 is located above the upper surface of the main support portion 78 including the landing area. Each of a plurality of second surfaces 87 (an example of a plurality of second guide portions) corresponding to an upper surface of the protruding portion of the first support portion 79 is located above the first surface 86. Accordingly, an upper surface of the first support portion 79 is constituted by the plurality of first surfaces 86 and the plurality of second surfaces 87, each having a predetermined length in the left-right directions 9, and the plurality of first surfaces 86 and the plurality of second surfaces 87 are alternately disposed. However, it is not necessary that the upper surface of the first support portion 79 is constituted by the plurality of first surfaces 86 and the plurality of second surfaces 87, as long as an upper end of the first support portion 79 has a structure allowing to guide the recording sheet 12. For example, the upper end of the first support portion 79 has such a structure that a plurality of ribs extending in the front-rear direction 8 are apart from each other in the left-right directions 9.

The plurality of first surfaces 86 are respectively disposed corresponding to the above-mentioned contact members 100 in the left-right directions 9. In other words, at least a part of a range in which each of the first surfaces 86 is formed in the left-right directions 9 overlaps a range (position) in which each of the contact members 100 is formed in the left-right directions 9. That is, a range in which each of the first surfaces 86 is formed in the left-right directions 9 may overlap a range in which each of the contact members 100 is formed in the left-right directions 9. Further, each of the first surfaces 86 may be formed within a greater range in the left-right directions 9 than a range in which each of the contact members 100 is formed in the left-right directions 9, so that the range in which each of the first surfaces 86 is formed may include the range (position) in which each of the contact members 100 is formed. On the contrary, each of the contact members 100 may be formed within a greater range than a range in which each of the first surfaces 86 is formed, so that the range in which each of the contact members 100 is formed may include the range (position) in which each of the first surfaces 86 is formed.

An upper end of each first surface 86 is located below the lower end of each contact member 100. In other words, each first surface 86 is located between the upper surface of the main support portion 78 and the lower end of each contact member 100 in the up-down directions 7.

The plurality of second surfaces 87 are respectively disposed corresponding to the ribs 71 in the left-right directions 9. In other words, at least a part of a range in which each of the second surfaces 87 is formed in the left-right directions 9 overlaps a range (position) in which each of the ribs 71 is formed in the left-right directions 9. As the most common structure, each of the second surfaces 87 may be formed within a greater range in the left-right directions 9 than a range in which each of the ribs 71 is formed in the left-right directions 9, so that the range in which each of the second surfaces 87 is formed may include the range (position) in which each of the ribs 71 formed. Further, as an uncommon structure, in a case where the rib 71 has a somewhat large width in the left-right directions 9, the following structure can be adopted. A range in which each of the second surfaces 87 is formed in the left-right directions 9 may overlap a range in which each of the ribs 71 is formed in the left-right directions 9. Furthermore, each of the ribs 71 may be formed within a greater range than a range in which each of the second surfaces 87 is formed, so that the range in which each of the ribs 71 is formed may include the range (position) in which each of the second surfaces 87 is formed.

An upper end of each second surface 87 is located below the nipping position of the recording sheet 12 by the pair of discharge rollers 59. In other words, each second surface 87 is located between each first surface 86 and the nipping position in the up-down directions 7. Further, in the present embodiment, the upper end of each second surface 87 is located below the upper end of each rib 71.

[Second Support Portion 80]

As shown in FIGS. 3 and 4, the second support portion 80 is disposed at a front side of the first support portion 79 of the platen 42, i.e., at a downstream side of the first support portion 79 in the feeding direction 15. The second support portion 80 is a front portion of the platen 42 having the flat-plate structure. An upper surface of the second support portion 80 is an inclined surface 88 (an example of a third guide portion) in which a rear end portion (an upstream end portion in the feeding direction 15) of the second support portion 80 is located below a front end portion (a downstream end portion in the feeding direction 15) thereof. In other words, the second support portion 80 has the inclined surface 88. As shown in FIGS. 7 and 8, on the inclined surface 88, there are formed a plurality of ribs 89 apart from each other in the left-right directions 9 and each extending in the front-rear directions 8. It is not necessary that the upper surface of the second support portion 80 is the inclined surface 88 extending in the left-right directions 9 and in the front-rear directions 8 as described before, and the upper surface of the second support portion 80 may have a structure allowing to guide the recording sheet 12 to the nipping position of the recording sheet 12 by the pair of discharge rollers 59. For example, the upper surface of the second support portion 80 may be structured to have only the plurality of ribs 89 without the inclined surface 88. In this case, the plurality of ribs 89 are examples of the third guide portion.

A rear portion of the inclined surface 88, i.e., one of opposite end portions of the inclined surface 88 that is closer to the first support portion 79 is located below the first surface 86 of the first support portion 79. Further, a front portion of the inclined surface 88, i.e., the other end portion of the inclined surface 88 that is closer to the pair of discharge rollers 59 is located in the vicinity of the nipping position of the recording sheet 12 by the pair of discharge rollers 59. In other words, the inclined surface 88 is inclined from a position lower than the first surface 86 toward the nipping position.

As shown in FIGS. 2 through 4, a plurality of spurs 90 are disposed above the second support portion 80. In other words, a lower end of each spur 90 is located above the inclined surface 88, i.e., an upper end of the third guide portion. Also, the lower end of each spur 90 is located below the nipping position of the recording sheet 12 by the pair of discharge rollers 59. That is, the lower end of each spur 90 is located between the inclined surface 88 and the nipping position in the up-down directions 7. Each spur 90 is opposed to the inclined surface 88 of the second support portion 80. The plurality of spurs 90 are apart from each other in the left-right directions 9. Each spur 90 is rotatably attached to the outer guide member 18.

[Ink-Absorbing Member 85]

As shown in FIGS. 3 and 4, below a rear portion of the platen 42, i.e., below an upstream side of the landing area in the feeding direction 15, there is disposed an ink-absorbing member 85 consisting of a porous material such as foamed polyurethane. Ink permeates into holes formed in the porous material, so that the ink-absorbing member 85 absorbs the ink. In the present embodiment, a lower surface of the ink-absorbing member 85 is supported by a plurality of hook portions 91 (shown in FIG. 9) each of which protrudes downward from a lower surface of the main support portion 78 such that an upper surface of the ink-absorbing member 85 is held in contact with the lower surface of the main support portion 78.

As shown in FIGS. 7 through 9, on the upper surface and the lower surface of the main support portion 78 of the platen 42, there is formed an ink channel 81. The ink channel 81 includes a plurality of slits 81A apart from each other in the left-right directions 9, each extending in the front-rear directions 8 and connecting the upper surface of the main support portion 78 to the lower surface thereof, a plurality of upper-surface channels 81B disposed in the landing area of the upper surface of the main support portion 78, and a plurality of lower-surface channels 81C disposed in the lower surface of the main support portion 78. Each upper-surface channel 81B is a small-groove-shaped channel extending in the left-right directions 9 between corresponding two of the plurality of slits 81A adjacent to each other, connected to the corresponding two of the plurality of slits 81A, and inclined toward one of the corresponding two of the plurality of slits 81A. Each lower-surface channel 81C is connected to the slit 81A and is a small-groove-shaped channel extending continuously in the left-right directions 9 and in the front-rear directions 8 from a position in which the lower-surface channel 81C and the slit 81A are connected to each other to a position in which the lower-surface channel 81C is in contact with the ink-absorbing member 85. Ink which lands on the landing area of the upper surface of the main support portion 78 flows from the upper-surface channels 81B to the lower-surface channels 81C through the slits 81A and is led to the ink-absorbing member 85 along the lower-surface channel 81C.

Further, in the main support portion 78 of the platen 42, there is formed at least one opening, in the present embodiment, seven openings 82. The openings 82 are formed within an area in which the ink-absorbing members 85 are disposed in the front-rear directions 8. Therefore, the ink-absorbing members 85 are exposed outside through the openings 82. In other words, in a case where the platen 42 is seen from an upper side thereof, the ink-absorbing members 85 can be seen through the openings 82.

[Media Sensor 110]

As shown in FIG. 2, the carriage 40 carries a media sensor 110 (an example of a sensor) for detecting the recording sheet 12 fed in the feeding path 65.

The media sensor 110 is disposed on a lower surface of the carriage 40. Further, in the present embodiment, the media sensor 110 is disposed at an upstream side of the recording head 38 (in detail, the aftermost one of the plurality of nozzles 39) in the feeding direction 15 and at a downstream side of the contact members 100 in the feeding direction 15, and located at a position in which the media sensor 110 can be opposed to the openings 82 in the front-rear directions 8. That is, in the present embodiment, the openings 82 are formed between the nozzle 39 located at the most rearward position and the contact members 100 in the front-rear directions 8.

The media sensor 110 comprises a light-emitting portion including a light-emitting diode and a light-receiving portion including an optical sensor. The light-emitting portion emits the light downward (in a direction toward the platen 42) with the amount of light instructed by a controller which controls overall operations of the MFD 10. The light emitted from the light-emitting portion is reflected by the platen 42 in a state in which the media sensor 110 is opposed to the platen 42, or the ink-absorbing members 85 in a state in which the media sensor 110 is opposed to the openings 82. The light-receiving portion receives the reflected light. The media sensor 110 outputs an electric signal corresponding to the amount of the reflected light received by the light-receiving portion to the controller. For example, the media sensor 100 outputs a high-level electric signal to the controller as the amount of the received light increases.

The controller recognizes the received amount of the reflected light based on the electric signal from the media sensor 110. In a case where the light-emitting portion emits the light in a state in which the media sensor 110 is opposed to the openings 82, the controller, when the electric signal from the light-receiving portion is equal to or smaller than a predetermined threshold value, determines that the ink-absorbing members 85 should be exchanged because the ink-absorbing members 85 become darker due to absorbing of a large amount of ink. Then, the controller controls a display portion 17 (shown in FIG. 1) such as a touch panel to display a message that the ink-absorbing members 85 should be exchanged.

Effects of the Present Embodiment

In the present embodiment, in the upstream side of the landing area in the feeding direction 15, the recording sheet 12 becomes in a waved shape in the left-right directions 9 by the contact members 100 and the ribs 71. The recording sheet 12 is supported by the first support portion 79, so that the waved shape of the recording sheet 12 can be maintained at a position of the first support portion 79 in the feeding direction 15, i.e., in the downstream side of the landing area in the feeding direction 15, and between the contact members 100 and the first support portion 79. Accordingly, the contact members 100 ad the ribs 71 constitute a corrugate mechanism which causes the sheet 12 to have a corrugated shape.

Further, in a case where a leading end of the recording sheet 12 in the feeding direction 15 passes the first support portion 79, it is possible that the leading end of the recording sheet 12 is curved, unable to keep in the waved shape. However, in the present embodiment, the curved leading end of the recording sheet 12 is inserted into a space between the first support portion 79 and the inclined surface 88 of the second support portion 80 in the up-down directions 7. Accordingly, it is restrained that a portion of the recording sheet 12 that is opposed to the recording portion 24 is deformed, e.g., the recording sheet 12 is lifted upward. As a result, such possibilities that the recording sheet 12 comes into contact with the recording sheet 12 or the recording sheet 12 is jammed in the feeding path 65 can be decreased.

Furthermore, in the present embodiment, the lower end of each contact member 100 is located below the upper end of each rib 71, so that amplitude of a wave of the wave-shaped recording sheet 12 can be large. As a result, the waved shape of the recording sheet 12 can be easily maintained.

Further, in the present embodiment, since each first surface 86 is located below the lower end of each contact member 100, such a possibility that the recording sheet 12 having the waved shape in the left-right directions 9 by the contact members 100 and the ribs 71 collides with a side surface of the first support portion 79 and is not supported by the first surface 86 can be reduced.

Further, in the present embodiment, in a case where the range in which each of the first surfaces 86 is formed includes the range in which each of the contact members 100 is formed in the left-right directions 9, the contact members 100 completely correspond to the first support portion 79, so that such a possibility that the waved shape of the recording sheet 12 cannot be maintained at the first support portion 79 in the feeding direction 15 can be reduced.

In the present embodiment, the recording sheet 12 positioned at the second support portion 80 in the feeding direction 15 is easily led to the nipping position of the recording sheet 12 by the pair of discharge rollers 59 along the inclined surface 88.

Furthermore, in the present embodiment, even in a case where the leading end of the recording sheet 12 in the feeding direction 15, the waved shape of the recording sheet 12 being maintained in the first support portion 79, passes the first support portion 79, the spurs 90 press the leading end of the recording sheet 12, so that the waved shape of the leading end of the recording sheet 12 can be maintained. Also, the spurs 90 press the other end (a trailing end) of the recording sheet 12 in the feeding direction 15, so that the other end of the recording sheet 12 is restrained from being curved.

In the present embodiment, as a thickness of the recording sheet 12 is greater, the platen 42 is moved more downward by the recording sheet 12 pressed by the contact members 100. Accordingly, a distance between the recording sheet 12 and the recording portion 24 can be kept constant, regardless of the thickness of the recording sheet 12.

Further, in the present embodiment, the platen 42 is rotationally moved about the shaft 64 of the discharge roller 62 as a lower roller of the pair of discharge rollers 59. Therefore, regardless of the rotation angles of the platen 42, the recording sheet 12 supported by the platen 42 can be easily led to the nipping position of the recording sheet 12 by the pair of discharge rollers 59 along the inclined surface 88 of the second support portion 80.

Furthermore, in the present embodiment, the ink-absorbing member 85 is disposed at the upstream side of the landing area in the feeding direction 15. Therefore, in a case where the platen 42 is rotationally moved downward, the ink channel 81 is inclined such that the ink-absorbing member 85 is located below the landing area. As a result, ink droplets that have landed on the landing area can easily flow to the ink-absorbing member 85.

In the present embodiment, since the lower end of each spur 90 is located above the second surface 87 in the up-down directions 7 and located below or at the same position as the nipping position in the up-down directions 7, as in the illustrated embodiment, the waved shape of the recording sheet 12 can be maintained and the recording sheet 12 is prevented from being curved, and also, the recording sheet 12 can be easily led to the nipping position.

In the present embodiment, since the ink-absorbing member 85 is exposed outside, the ink-absorbing member 85 can be easily dried.

Further, in the present embodiment, based on the size of the electric signal outputted from the media sensor 110, depth of color of the ink-absorbing member 85 can be detected. The ink-absorbing member 85 becomes darker, as a large amount of ink is absorbed. In other words, in the present embodiment, based on the electric signal outputted from the media sensor 110, the exchange period of the ink-absorbing member 85 can be determined.

MODIFIED EXAMPLE 1

In the illustrated embodiment, the platen 42 is supported to be rotationally movable in the direction of the arrow 74 by the shaft 64 of the discharge roller 62 as the lower roller of the pair of discharge rollers 59. However, as long as one end of the platen 42 disposed at an upstream portion thereof in the feeding direction 15 is rotationally movable in the direction of the arrow 74 about a shaft disposed at a downstream portion thereof in the feeding direction 15, the platen 42 may be supported by a shaft other than the shaft 64.

MODIFIED EXAMPLE 2

In the illustrated embodiment, the exchange period of the ink-absorbing member 85 is determined by emitting of the light from the media sensor 110 for detecting the recording sheet 12 fed in the feeding path 65 toward the ink-absorbing member 85. However, a sensor that emits light toward the ink-absorbing member 85 is not limited to the media sensor 110. For example, an individual sensor for emitting light toward the ink-absorbing member 85 may be disposed at a position opposed to the openings 82.

MODIFIED EXAMPLE 3

In the illustrated embodiment, the media sensor 110 is located at the downstream side of the contact members 100 in the feeding direction 15. However, as long as the media sensor 110 is disposed at a position allowed to be opposed to the openings 82 in the front-rear directions 8, the media sensor 110 may be disposed at the same position as the contact members 100 in the front-rear directions 8 or at an upstream side of the contact members 100 in the feeding direction 15. In this case, needless to say, it is necessary that the openings 82 are located at the same position as the media sensor 110 in the front-rear directions 8. In a case where the media sensor 110 is located at the same position as the contact members 100 in the front-rear directions 8, it is necessary that the openings 82 is disposed at a position different from the contact members 100 in the left-right directions 9.

MODIFIED EXAMPLE 4

In the illustrated embodiment, as shown in FIGS. 3 and 4, the lower end of each spur 90 is located below the nipping position of the recording sheet 12 by the pair of discharge rollers 59. The lower end of each spur 90 may be located above the nipping position of the recording sheet 12 by the pair of discharge rollers 59. The nipping position may be located between the second surface 87 and the lower end of each spur 90 in the up-down directions 7. Further, the lower end of each spur 90 may be located at the same position as the nipping position in the up-down directions 7.

MODIFIED EXAMPLE 5

In the illustrated embodiment, the platen 42 is rotationally movable between the first position and the second position. However, the platen 42 may be moved in a manner except the rotational movement. For example, the platen 42 may be movable between the first position and the second position in the up-down directions 7. In the illustrated embodiment and the modified examples, the plurality of contact members 100 are respectively disposed between the plurality of ribs 71, but the MFD 10 may comprise two ribs 71 and one contact member 100 that is disposed between the two ribs 71.

What is claimed is:

1. An inkjet recording apparatus comprising:

a support member having a plurality of ribs apart from each other in a width direction which intersects with a feeding direction which is a direction in which a sheet is fed, and configured to support a lower surface of the sheet at an upper end of each of the plurality of ribs;

a head disposed above the support member and configured to eject ink to the sheet supported by the support member from nozzles; and at least one contact portion disposed upstream of the nozzles in the feeding direction and each disposed between corresponding two of the plurality of ribs adjacent to each other in the width direction, and configured to come in contact with an upper surface of the sheet in a state in which a lower surface of the sheet is supported by the plurality of ribs so as to make the sheet a waved shape, wherein the support member comprises:

a first support portion disposed downstream of a landing area of the support member and the plurality of ribs of the support member in the feeding direction, the landing area being an area on which ink droplets ejected from the nozzle land, wherein the first support portion comprises (a) at least one first guide portion disposed corresponding to the at least one contact portion in the width direction and located above the landing area, and (b) a plurality of second guide portions respectively disposed corresponding to the plurality of ribs in the width direction and located above the at least one first guide portion; and a second support portion comprising a third guide portion disposed downstream of the first support portion in the feeding direction, wherein one of opposite end portions of the third guide portion which is closer to the first support portion is located below the first guide portion, and wherein each of a plurality of contact portions as the at least one contact portion is disposed between the corresponding two of the plurality of ribs adjacent to each other.

2. The inkjet recording apparatus according to claim 1, wherein a lower end of each of the at least one contact portion is located below the upper end of each of the plurality of ribs.

3. The inkjet recording apparatus according to claim 1, wherein an upper end of each of the plurality of first guide portions is located below a lower end of each of the at least one contact portion.

4. The inkjet recording apparatus according to claim 1, wherein each of the plurality of first guide portions is formed at a range including a range where a corresponding one of the at least one contact portion is formed in the width direction.

5. The inkjet recording apparatus according to claim 1, further comprising a pair of rollers disposed downstream of the second support portion in the feeding direction and configured to nip and feed the sheet in the feeding direction, wherein the third guide portion is configured to guide the sheet to a nipping position of the pair of rollers.

6. The inkjet recording apparatus according to claim 5, further comprising a spur disposed above the second support portion to be opposed to the second support portion, wherein the nipping position of the pair of rollers is located above an upper end of the third guide portion, wherein a lower end of the spur is located above the upper end of the third guide portion and below the nipping position.

7. The inkjet recording apparatus according to claim 5, wherein the third guide portion is inclined toward the nipping position of the pair of rollers.

8. The inkjet recording apparatus according to claim 7, wherein the support member is rotationally movable between a first position and a second position at which a distance between the support member and the head in a vertical direction is greater than that at the first position about an axis of one of two rollers constituting the pair of rollers which is located below the other roller, wherein the support member further comprises a force applying member configured to apply force to the support member so as to rotationally move from the second position to the first position.

9. The inkjet recording apparatus according to claim 1, wherein the support member is movable between a first position and a second position at which a distance between the support member and the head in a vertical direction is greater than that at the first position, wherein the support member further comprises a force applying member configured to apply force to the support member so as to move from the second position to the first position.

10. The inkjet recording apparatus according to claim 9, further comprising an ink-absorbing member configured to absorb the ink droplets and disposed to be in contact with the support member at an upstream side of the landing area in the feeding direction, wherein the support member is rotationally movable between the first position and the second position, and an upstream end of the support member at the second position in the feeding direction is located below the upstream end of the support member at the first position in the feeding direction, and wherein the support member has an ink channel at which the ink droplets adhered to the landing area are led to the ink-absorbing member.

11. The inkjet recording apparatus according to claim 10, wherein the ink-absorbing member is disposed below the support member, wherein the support member has an opening through which the ink-absorbing member is exposed outside.

12. The inkjet recording apparatus according to claim 11, further comprising a sensor disposed to be opposed to the opening, wherein the sensor is configured to receive reflected light generated by emission of light and output electric signals corresponding to the received amount of the reflected light.

13. The inkjet recording apparatus according to claim 1, wherein the at least one first guide portion and the plurality of second guide portions arranged along the width direction.

14. The inkjet recording apparatus according to claim 1, wherein the first support portion comprises an inclined portion inclined toward the at least one first guide portion and the plurality of second guide portions in the feeding direction.

15. An inkjet recording apparatus comprising:

a support member having a plurality of ribs apart from each other in a width direction which intersects with a feeding direction which is a direction in which a sheet is fed, and configured to support a lower surface of the sheet at an upper end of each of the plurality of ribs;

a head disposed above the support member and configured to eject ink to the sheet supported by the support member from nozzles; and at least one contact portion disposed upstream of the nozzles in the feeding direction and each disposed between corresponding two of the plurality of ribs adjacent to each other in the width direction, and configured to come in contact with an upper surface of the sheet in a state in which a lower surface of the sheet is supported by the plurality of ribs so as to make the sheet a waved shape, wherein the support member comprises:

a first support portion disposed downstream of the nozzles in the feeding direction, wherein the first support portion comprises (a) at least one first guide portion disposed downstream of the nozzles in the feeding direction and disposed corresponding to the at least one contact portion in the width direction, and (b) a plurality of second guide portions respectively disposed corresponding to the plurality of ribs in the width direction and located above the at least one first guide portion, the at least one first guide portion and the plurality of second guide portions being arranged alternately in the width direction; and a second support portion comprising a third guide portion disposed downstream of the first support portion in the feeding direction, wherein one of opposite end portions of the third guide portion, which is closer to the first support portion, in the feeding direction, is located below the first guide portion.

16. An inkjet recording apparatus comprising:

a support member having a plurality of ribs apart from each other in a width direction which intersects with a feeding direction which is a direction in which a sheet is fed, and configured to support a lower surface of the sheet at an upper end of each of the plurality of ribs;

a head disposed above the support member and configured to eject ink to the sheet supported by the support member from nozzles;

a pair of rollers disposed upstream of the support member in the feeding direction and configured to nip and feed the sheet in the feeding direction; and at least one contact portion disposed downstream of a nip point of the pair of rollers and upstream of the nozzles in the feeding direction and each disposed between corresponding two of the plurality of ribs adjacent to each other in the width direction, and configured to come in contact with an upper surface of the sheet in a state in which a lower surface of the sheet is supported by the plurality of ribs so as to make the sheet a waved shape, wherein a downstream end of the at least one contact portion in the feeding direction extends toward the support member, wherein the support member comprises:

a first support portion disposed downstream of the nozzles in the feeding direction, wherein the first support portion comprises (a) at least one first guide portion disposed downstream of the nozzles in the feeding direction and disposed corresponding to the at least one contact portion in the width direction, and (b) a plurality of second guide portions respectively disposed corresponding to the plurality of ribs in the width direction and located above the at least one first guide portion; and a second support portion comprising a third guide portion disposed downstream of the first support portion in the feeding direction, one of opposite end portions of the third guide portion, which is closer to the first support portion, in the feeding direction, being located below the first guide portion.

* * * * *